US010808381B2

(12) United States Patent
Goebel et al.

(10) Patent No.: US 10,808,381 B2
(45) Date of Patent: Oct. 20, 2020

(54) LIFTING MECHANISM SUSPENSION AND LIFTING MECHANISM

(71) Applicant: Robert Bosch GmbH, Stuttgart (DE)

(72) Inventors: Christian Goebel, Karlstadt (DE); Edwin Harnischfeger, Jossgrund (DE); Florian Herold, Karsbach (DE); Rainer Biener, Steinfeld (DE); Wolfgang Hupp, Hafenlohr (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/405,717

(22) Filed: May 7, 2019

(65) Prior Publication Data

US 2020/0002919 A1 Jan. 2, 2020

(30) Foreign Application Priority Data

Jun. 27, 2018 (DE) ..... 10 2018 210 471

(51) Int. Cl.

| | |
|---|---|
| ***F15B 1/027*** | (2006.01) |
| ***E02F 9/22*** | (2006.01) |
| ***F15B 11/10*** | (2006.01) |
| ***F15B 13/02*** | (2006.01) |

(52) U.S. Cl.

CPC ..... *E02F 9/2207* (2013.01); *E02F 9/2217* (2013.01); *E02F 9/2225* (2013.01); *E02F 9/2267* (2013.01); *E02F 9/2271* (2013.01); *E02F 9/2296* (2013.01); *F15B 1/027* (2013.01); *F15B 11/10* (2013.01); *F15B 13/024* (2013.01); *F15B 13/027* (2013.01); *F15B 2211/20546* (2013.01); *F15B 2211/55* (2013.01); *F15B 2211/7053* (2013.01)

(58) Field of Classification Search

CPC ..... F15B 1/021; F15B 1/02; E02F 9/2207; E02F 9/2217

See application file for complete search history.

(56) References Cited

U.S. PATENT DOCUMENTS

| | | | | |
|---|---|---|---|---|
| 5,733,095 A * | 3/1998 | Palmer | E02F 9/2207 414/685 |
| 6,351,944 B1 * | 3/2002 | Fertig | F15B 1/021 60/413 |
| 6,634,653 B2 * | 10/2003 | Chatterjea | B60G 17/056 280/5.5 |

(Continued)

FOREIGN PATENT DOCUMENTS

| | | |
|---|---|---|
| DE | 39 09 205 C1 | 5/1990 |
| DE | 10 2010 053 258 A1 | 6/2011 |

(Continued)

*Primary Examiner* — Thomas E Lazo

(74) *Attorney, Agent, or Firm* — Maginot, Moore & Beck LLP

(57) ABSTRACT

A hydraulic lifting mechanism suspension has a main valve in the activation position whereof at least one hydraulic accumulator is connected to a connection line of the lifting mechanism suspension acting in the lifting direction or to working line of the lifting mechanism suspension acting in the lifting direction. The lifting mechanism suspension is deactivated via a deactivation position of the main valve, while at the same time a connection for recharging or filling the hydraulic accumulator is opened.

12 Claims, 3 Drawing Sheets

(56) References Cited

U.S. PATENT DOCUMENTS

| | | | | |
|---|---|---|---|---|
| 7,621,124 | B2 * | 11/2009 | Mizoguchi | E02F 9/2217 60/469 |
| 7,637,103 | B2 * | 12/2009 | Karl | E02F 9/2207 60/469 |
| 7,703,280 | B2 * | 4/2010 | Kobayashi | E02F 9/2207 60/469 |
| 7,793,740 | B2 * | 9/2010 | Thomson | E02F 3/7663 172/795 |
| 8,997,958 | B2 * | 4/2015 | Schuller | F16H 61/0206 192/48.601 |
| 2017/0254308 | A1 * | 9/2017 | Mast | F15B 11/165 |

FOREIGN PATENT DOCUMENTS

| | | | | |
|---|---|---|---|---|
| DE | 102012208307 | A1 * | 11/2013 | E02F 9/2207 |
| DE | 10 2014 107 327 | A1 | 11/2015 | |
| DE | 10 2014 107 391 | A1 | 11/2015 | |
| EP | 1 778 923 | B1 | 5/2007 | |

* cited by examiner

LIFTING MECHANISM SUSPENSION AND LIFTING MECHANISM

This application claims priority under 35 U.S.C. § 119 to application no. DE 10 2018 210 471.9, filed on Jun. 27, 2018 in Germany, the disclosure of which is incorporated herein by reference in its entirety.

The present disclosure relates to a suspension based on gas compressibility for a hydraulic lifting mechanism of a mobile working machine and, furthermore, also a lifting mechanism with a lifting mechanism suspension of this kind.

BACKGROUND

Lifting mechanism shock absorption systems or lifting mechanism suspensions based on the compressibility of the air enclosed in hydraulic accumulators are known in the art in relation to hydraulic lifting mechanisms of mobile working machines, e.g. the lifting mechanism for the loading bucket of a wheel loader. In this way, pitch vibrations of the wheel loader are reduced and damped, particularly when said wheel loader is traveling quickly over uneven ground with a full bucket.

DE 39 09 205 C1 and EP 1 778 923 B1 each show a lifting mechanism with a hydraulic lifting mechanism suspension of this kind. The lifting mechanism has a control valve which is connected to a cylinder chamber acting in the lifting direction via a working line acting in the lifting direction and to a cylinder chamber of a double-acting lifting cylinder acting in the lowering direction via a working line acting in the lowering direction. The associated lifting mechanism suspension has at least one hydraulic accumulator and a main valve which is referred to in DE 39 09 205 C1 as the shut-off valve and is configured as a pre-controlled 4/2-way valve in EP 1 778 923 B1. The hydraulic accumulator can be connected to the working line acting in the lifting direction via this main valve, while the working line acting in the lowering direction is relieved via a tank line.

A recharging or filling function for the at least one hydraulic accumulator of the lifting mechanism suspension is also disclosed in both publications.

A filler valve is provided in EP 1 778 923 B1 which connects the working line acting in the lifting direction to the hydraulic accumulator. The filling function is therefore achieved using the load pressure of the lifting cylinder which is tapped between the control valve and the lifting cylinders.

A filler valve is disclosed in DE 39 09 205 C1 (in the case of an exemplary embodiment), via which a main line which connects a pump to the control valve of the lifting mechanism can be connected to the hydraulic accumulator. The filling function is therefore achieved with the pump pressure which is tapped between the pump and the control valve.

In both publications the filler valve is arranged or configured as a bypass to the main valve.

With both prior-art lifting mechanism suspensions, the main valve can therefore be opened in order to activate the lifting mechanism suspension, while the filler valve is open at the same time in order to recharge or fill the hydraulic accumulator. According to this, the problem addressed by the present disclosure is that of creating a lifting mechanism suspension and a lifting mechanism with a suspension of this kind in which this disadvantage is avoided.

This problem is solved by a lifting mechanism suspension having the features disclosed herein and by a lifting mechanism having the features disclosed herein.

SUMMARY

The disclosed lifting mechanism suspension is designed for a lifting mechanism of a mobile working machine, wherein the lifting mechanism has at least one (preferably two) lifting cylinder(s). The lifting mechanism suspension has a main valve via which, in the working position thereof, a hydraulic accumulator or an accumulator line attached thereto is connected to a connection line acting in the lifting direction, while a connection line acting in the lowering direction is connected to a tank line. The lifting mechanism suspension is thereby activated in the activation position of the main valve. In a deactivation position of the main valve, the two connection lines and the tank line are shut off in respect of one another. The lifting mechanism suspension is therefore deactivated when the main valve is in the deactivation position.

According to the disclosure, the main valve has a fifth connection which is connected or connectable to a pressure medium source. When the main valve is in the deactivation position, the hydraulic accumulator or the accumulator line is connected to the fifth connection according to the disclosure. It is thereby ensured that the hydraulic accumulator is only charged or filled when the lifting mechanism suspension is deactivated and the hydraulic accumulator is not charged. The working line acting in the lifting direction and therefore the lifting mechanism can be charged during this.

The main valve may be a 5/2-way valve or also a 6/2-way valve. In the latter case, the sixth connection of the 6/2-way valve is connected to the accumulator line or the hydraulic accumulator and to the fifth connection in the deactivation position.

The pressure medium source is preferably a variable displacement pump and is used to supply the lifting mechanism and preferably additional consumers.

An adjustable pressure-limiting valve is preferably provided on the accumulator line or on a pump line via which the fifth connection of the main valve is connected to the pressure medium source. The maximum accumulator charging pressure is thereby determined.

A constantly adjustable filler valve is preferably arranged in the pump line and therefore between the pressure medium source and the fifth connection. Said filler valve is preferably pretensioned by a spring into an open position and controllable by the pump pressure in the pump line.

With a particularly preferred development, the filler valve creates a 2-way flow regulator with a throttle. Moreover, the volume flow with which the hydraulic accumulator is charged is determined.

A non-return valve which opens from the throttle to the main valve is preferably arranged in the pump line between the throttle and the main valve.

An activation valve acting as a pre-control valve is preferably provided, via which the main valve can be switched into the activation position or can be adjusted into one of multiple activation positions. Moreover, a control pressure line can be connected to the accumulator line via the activation valve, wherein the main valve can then be switched into its activation position via a control pressure in the control pressure line or can be adjusted into its activation positions.

A shut-off valve is preferably provided, via which the accumulator line can be connected to the tank line. The connection is opened via a valve body of the shut-off valve when the control pressure in the control pressure line is higher than a working pressure in the connection line acting in the lifting direction in addition to the equivalent of a spring engaging with the valve body.

A further control pressure line is preferably provided which connects the connection line acting in the lifting direction to a control pressure chamber of the shut-off valve. A throttle is preferably arranged in the other control pressure line.

If the main valve is constantly adjustable, the lifting mechanism suspension according to the disclosure can be continuously activated and deactivated.

The performance of the continuously adjustable main valve is improved in this case when a throttle non-return valve is arranged in the control pressure line adjacent to a control pressure chamber of the main valve acting in the opening direction, wherein an opening direction of the corresponding non-return valve is directed away from the control pressure chamber.

If the pump of the lifting mechanism concerned or of the mobile working machine concerned is a displacement pump, a load pressure signaling line preferably branches from the pump line. In this case, the branch is preferably arranged between the filler valve and the non-return valve. The displacement pump can then be controlled depending on the maximum load pressure of the consumers supplied by it, to which the lifting mechanism suspension according to the disclosure and the lifting mechanism concerned belong. The pump line is preferably connected to the load pressure signaling line via an electrically actuable switching valve.

A throttle is preferably arranged in the load pressure signaling line between the pump line and the switching valve.

If the lifting mechanism suspension according to the disclosure comprises a valve block, a continuous main pump line and/or a continuous load pressure signaling line and/or one or two continuous main tank lines can be provided therein. The pump line can then be connected to the main pump line and/or the load pressure signaling line to the main load pressure signaling line and/or the tank line to the main tank line or to one of the two main tank lines.

A non-return valve which opens from the accumulator line to the main load pressure signaling line is preferably arranged in the load pressure signaling line. It is thereby ensured that only the highest load pressure of all consumers supplied by the displacement pump is used for the adjustment thereof.

The disclosed lifting mechanism comprises a control valve which is connected to a cylinder chamber acting in the lifting direction via a working line acting in the lifting direction and to a cylinder chamber of a double-acting lifting cylinder acting in the lowering direction via a working line acting the lowering direction. The lifting mechanism according to the disclosure has a previously described lifting mechanism suspension, the connection line whereof acting in the lifting direction is attached to the working line acting in the lifting direction, while the connection line acting in the lowering direction is connected to the working line acting in the lowering direction.

The control valve of the lifting mechanism according to the disclosure is preferably received in a control valve block which is compatible with the valve block of the lifting mechanism suspension. This means, in particular, that the two valve blocks have equally sized bearing surfaces and outlets for the main tank line and/or the main pump line and/or the main load pressure signaling line which are arranged opposite one another.

DETAILED DESCRIPTION

Figure 1:
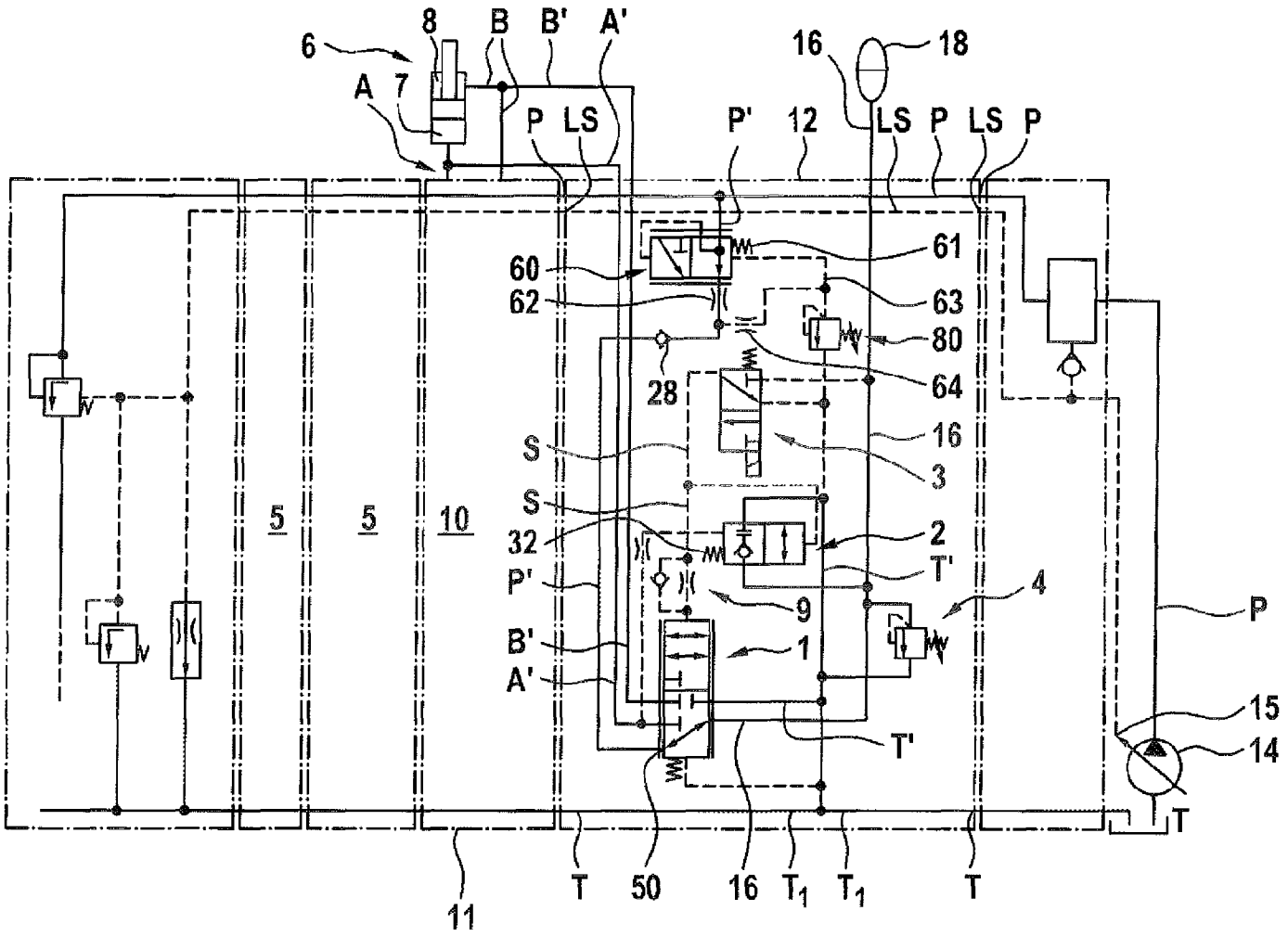
FIG. 1 shows a connection diagram of the lifting mechanism according to a first exemplary embodiment with additional consumers of a mobile working machine.

FIG. 1 shows a connection diagram of the disclosed lifting mechanism according to a first exemplary embodiment with additional consumers 5 of a mobile working machine (not shown in greater detail), e.g. a wheel loader. Two cylinders 6 of the lifting mechanism arranged parallel to one another each have a cylinder chamber 7 acting in the lifting direction and a cylinder chamber 8 acting in the lowering direction. The two cylinder chambers 7 acting in the lifting direction are connected to a control valve block 11 via a branched working line A acting in the lifting direction. The two cylinder chambers 8 acting in the lowering direction are connected to the control valve block 11 via a branched working line B acting in the lowering direction. A control valve 10 (not shown in greater detail) which is controlled via a control element (not shown) of the mobile working machine is arranged in the control valve block 11, so that piston rods of the two lifting cylinders 6 are extended in the lifting direction or retracted in the lowering direction.

A valve block 12 is located on a bearing surface of the control valve block 10, in or on which substantial elements of the lifting mechanism suspension according to the disclosure are arranged. More specifically, a continuous main pump line P, a continuous main load pressure signaling line LS and a continuous main tank line $T_1$ are provided in the valve block 12.

The main pump line P is connected to a displacement pump 14 of the lifting mechanism, the main load pressure signaling line LS is connected to a displacement device 15 of the displacement pump 14 and the main tank line $T_1$ to a tank of the mobile working machine.

Furthermore, a connecting line A' acting in the lifting direction which is configured as a channel is provided in the inside of the valve block 12 and is connected to the working line A acting in the lifting direction. Furthermore, a connection line B' acting in the lowering direction is provided in the inside of the valve block 12, which connection line is likewise configured as a channel and is correspondingly connected to the working line B acting in the lowering direction.

The two working lines A, B are connected to a main valve 1 configured as a constantly adjustable 5/2-way valve via the two connection lines A', B'. In a basic position of a valve body of the main valve 1 pretensioned by a spring (shown in the figure) which is referred to as the deactivation position, the two connection lines A', B' are closed off.

In an activation position of the valve body of the main valve 1 adjustable by a control pressure in a control pressure line S, the cylinder chambers 7 acting in the lifting direction are connected to a hydraulic accumulator 18 via the corresponding working line A and via the corresponding connection line A' and furthermore via an accumulator line 16. A closed air chamber is formed in the hydraulic accumulator 18, as a result of which the hydraulic accumulator 18 along with the arrangement received in the inside of the valve block 12 creates a lifting mechanism suspension.

By increasing the control pressure prevailing in the control pressure line S, the valve body of the main valve 1 is constantly moved into one of these activation positions (at the bottom in the figure). During this, the control pressure medium flows out of the control pressure line S via a throttle non-return valve 9, the non-return valve whereof opens from the main valve 1 to the control pressure line S.

The increase in the control pressure in the control pressure line S takes place via an activation valve 3 configured as a 3/2-way valve. In a basic position of a valve body of the activation valve 3 pretensioned by a spring (shown in the figure), the control pressure line S is relieved via a tank line T' to the main tank line $T_1$. When an actuator of the activation valve 3 is flowed through, the accumulator line 16 in which accumulator charging pressure constantly prevails is connected to the control pressure line S.

In order to refill the hydraulic accumulator 18 or to increase the pressure thereof, the main pump line P can be filled with pressure medium via a pump line P' in which a constantly adjustable filler valve 60 and a throttle 62 are arranged and via the storage line 16. The filler valve 60 and the throttle 62 in this case are arranged between the variable displacement pump 14 and the fifth connection 50.

The filler valve 60 is pretensioned by a spring 61 and by the pump pressure in the pump line P' downstream of the throttle 62 into an open position (shown in FIG. 1). A control line 63 in which a throttle 64 is arranged is used for this purpose. The filler valve 60 is charged or controllable by the pump pressure in the pump line P' upstream of the filler valve 60. In this way, the filler valve 60 and the throttle 62 create a 2-way flow regulator. The volume flow with which the hydraulic accumulator 18 is filled or charged is determined via said flow regulator.

The control pressure in the control line 63 acting in the direction of the open position of the filler valve 60 is limited via an adjustable pressure-limiting valve 80 which is connected to the tank line T' on the output side.

A non-return valve 28 is arranged in the pump line P' between the throttle 62 and the fifth connection 50 of the main valve 1, the opening direction of said non-return valve being directed from the throttle 62 to the fifth connection 50 and therefore to the main valve 1 and therefore to the hydraulic accumulator 18.

A shut-off valve 2 is connected to the accumulator line 16 between the main valve 1 and the hydraulic accumulator 18, via which shut-off valve a connection from the accumulator line 16 to the main tank line $T_1$ is controlled when the working pressure of the connection line A' plus the equivalent of a spring 32 is greater than the control pressure of the control pressure line S.

A pressure-limiting valve 4 which connects the accumulator line 16 to the tank line T' when a maximum accumulator charging pressure is reached is provided parallel to the shut-off valve 2.

The main load pressure signaling line LS previously referred to passes through the valve block 12, wherein the first exemplary embodiment of the disclosed lifting mechanism suspension according to FIG. 1 has no connection to the main load pressure signaling line LS and the load pressure of the lifting mechanism suspension therefore has no influence on the displacement device 15 of the variable displacement pump 14.

Figure 2:
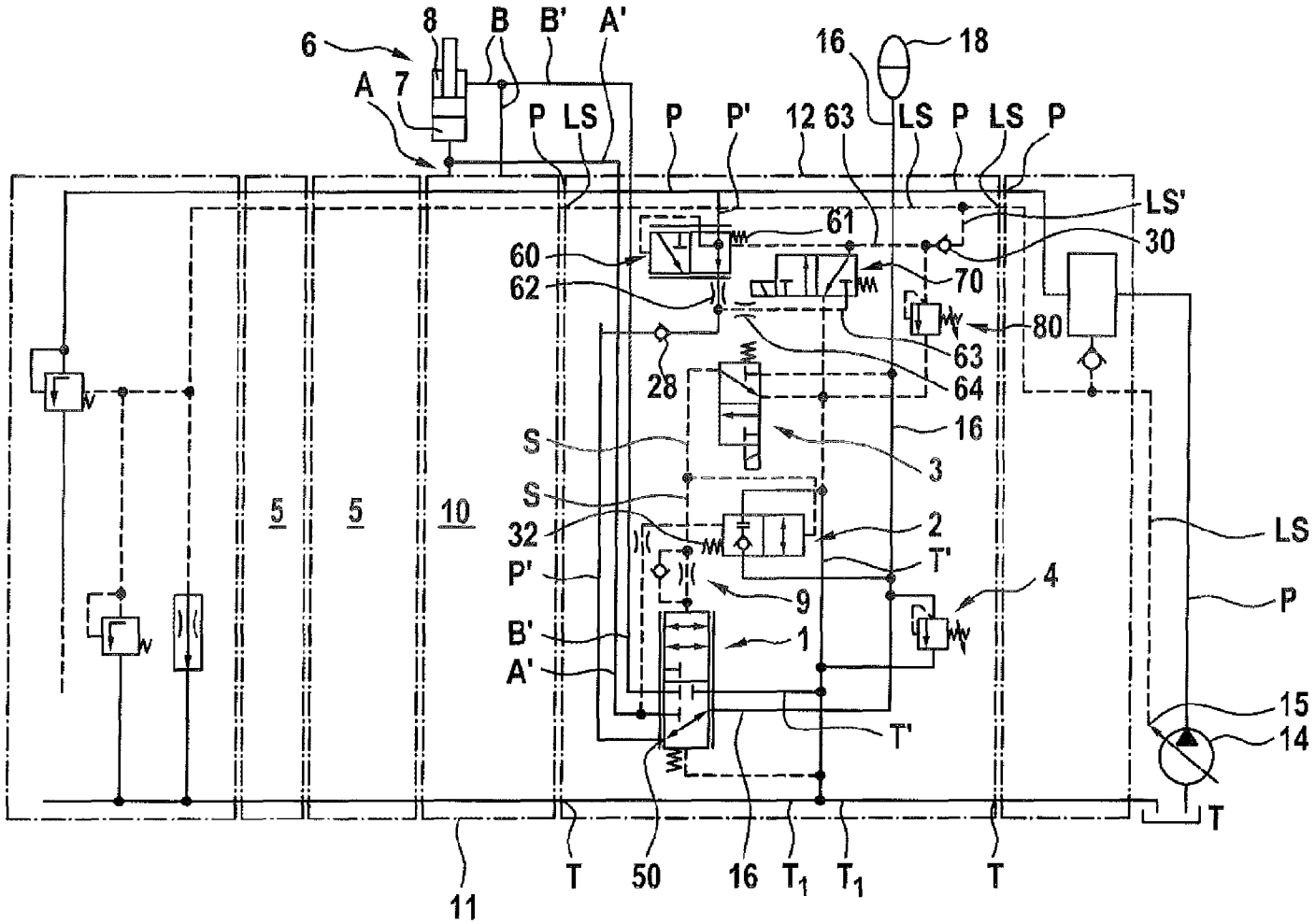
FIG. 2 shows a connection diagram of the lifting mechanism according to a second exemplary embodiment with additional consumers of a mobile working machine.

FIG. 2 shows a connection diagram of the disclosed lifting mechanism according to a second exemplary embodiment, wherein the periphery of the valve block 12, e.g. the additional consumers 5, the lifting cylinder 6, the hydraulic accumulator 18, the displacement pump 14 and the control valve block 11 correspond to those of the first exemplary embodiment from FIG. 1.

The following differences or additions to the first exemplary embodiment from FIG. 1 are provided within the valve block 12.

An electrically adjustable switching valve 70 is arranged in the control pressure line 63 of the flow regulator formed from the filler valve 60 and the throttle 62. In the basic position of the switching valve 70 pretensioned by a spring (shown in FIG. 2), the hydraulic accumulator 18 can only be charged if the accumulator charging pressure falls below the equivalent of the spring 61 at the filler valve 60. The other switch setting of the switching valve 70 connects both parts of the control line 63, the second exemplary embodiment functioning like the first exemplary embodiment.

A load pressure signaling line LS' which signals the accumulator charging pressure of the disclosed lifting mechanism suspension which is to be regarded as the consumer to the continuous main load pressure signaling line LS branches from the control pressure line 63. This can take place via a changeover valve (not shown) or via a non-return valve 30, whereby it is ensured that the highest load pressure of all consumers 5 supplied by the variable displacement pump 14, including the lifting mechanism suspension according to the disclosure, is signaled to the displacement device 15 of the variable displacement pump 14.

Figure 3:
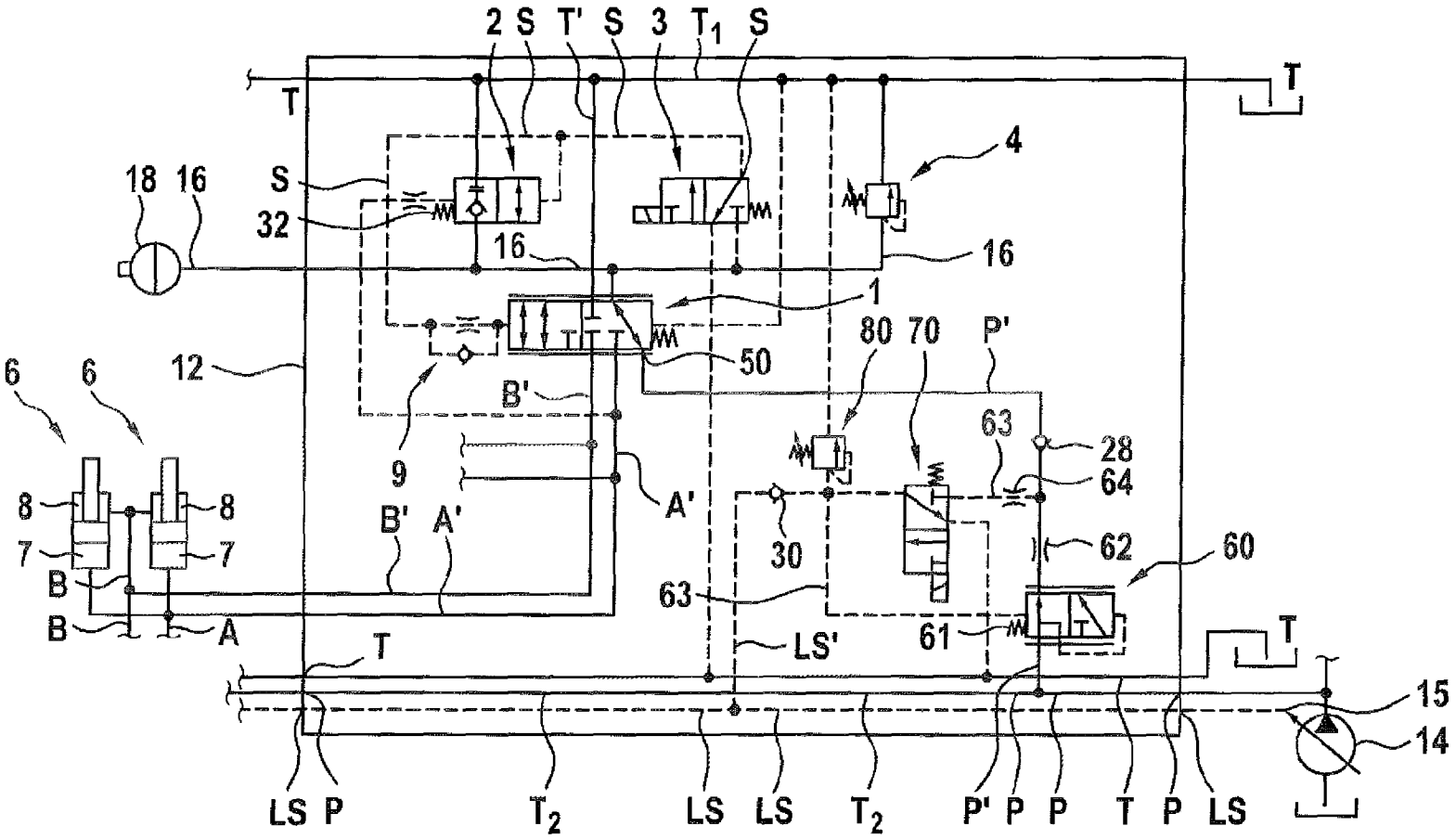
FIG. 3 shows a connection diagram of the lifting mechanism according to a third exemplary embodiment.

FIG. 3 shows a connection diagram of the disclosed lifting mechanism according to a third exemplary embodiment, wherein its control valve block 11 was omitted. Two lifting cylinders 6 are provided, wherein the working line A acting in the lifting direction branches to the two cylinder chambers 7 acting in the lifting direction, while the working line B acting in the lowering direction branches to the two cylinder chambers 8 acting in the lowering direction.

A second main tank line $T_2$ passing through the valve block 12 should be regarded as the substantial difference between the third exemplary embodiment and the second exemplary embodiment according to FIG. 2. In this case, the main valve 1, the shut-off valve 2 and the two pressure-limiting valves 4, 80 are connected to the first main tank line $T_1$, while the activation valve 3 and the switching valve 70 are connected to the second main tank line $T_2$.

A hydraulic lifting mechanism suspension and a corresponding lifting mechanism of a mobile working machine are disclosed. The lifting mechanism suspension has a main valve in the activation position whereof at least one hydraulic accumulator is connected to a connection line of the lifting mechanism suspension acting in the lifting direction or to a working line of the lifting mechanism acting in the lifting direction. The lifting mechanism suspension is deactivated via a deactivation position of the main valve, while at the same time a connection for recharging or filling the hydraulic accumulator is opened.

LIST OF REFERENCE NUMBERS

1 Main valve
2 Shut-off valve
3 Activation valve
4 Pressure-limiting valve
5 Additional consumer

6 Lifting cylinder
7 Cylinder chamber acting in the lifting direction
8 Cylinder chamber acting in the lowering direction
9 Throttle non-return valve
10 Control valve
11 Control valve block
12 Valve block
14 Variable displacement pump
15 Displacement device
16 Accumulator line
18 Hydraulic accumulator
28 Non-return valve
30 Non-return valve
32 Spring
50 Fifth connection
60 Filler valve
61 Spring
62 Throttle
63 Control line
64 Throttle
70 Switching valve
80 Pressure-limiting valve
A Working line acting in the lifting direction
A' Connection line acting in the lifting direction
B Working line acting in the lowering direction
B' Connection line acting in the lowering direction
LS Main load pressure signaling line
LS' Load pressure signaling line
P Main pump line
P' Pump line
S Control pressure line
$T_1$, $T_2$ Main tank line
T Tank/tank connection
T' Tank line

The invention claimed is:

1. A lifting mechanism suspension for a lifting mechanism, the lifting mechanism suspension comprising:

a main valve having an activation position in which a hydraulic accumulator or an accumulator line connected to an accumulator is connected to a first connection line that acts in a lifting direction, while a second connection line acting in a lowering direction is connected to a tank line, and a deactivation position in which the first and second connection lines and the tank line are disconnected from one another, while the hydraulic accumulator or the accumulator line is configured to be connected to a pressure medium source via a fifth connection of the main valve; and a filler valve which creates a 2-way flow regulator with a throttle, the filler valve arranged between the pressure medium source and the fifth connection.

2. The lifting mechanism suspension according to claim 1, wherein the pressure medium source includes a variable displacement pump that supplies at least one lifting mechanism.

3. The lifting mechanism suspension according to claim 1, wherein:

the pressure medium source is connected to the fifth connection of the main valve via a pump line, and one of the pump line and the accumulator line is secured via an adjustable pressure-limiting valve.

4. The lifting mechanism suspension according to claim 1, wherein the main valve has additional activation positions and is constantly adjustable.

5. The lifting mechanism suspension according to claim 1, further comprising:

a valve block.

6. The lifting mechanism suspension according to claim 5, wherein the valve block defines at least one of a continuous main pump line, a continuous load pressure signaling line, a first continuous main tank line, and a second continuous main tank line.

7. A lifting mechanism suspension for a lifting mechanism, the lifting mechanism suspension comprising:

a main valve having an activation position in which a hydraulic accumulator or an accumulator line connected to an accumulator is connected to a first connection line that acts in a lifting direction, while a second connection line acting in a lowering direction is connected to a tank line, and a deactivation position in which the first and second connection lines and the tank line are disconnected from one another, while the hydraulic accumulator or the accumulator line is configured to be connected to a pressure medium source via a fifth connection of the main valve; and an activation valve configured to connect the accumulator line to a control pressure line, wherein control pressure in the control pressure line switches or adjusts the main valve into the activation position.

8. The lifting mechanism suspension according to claim 7, further comprising:

a shut-off valve configured to connect the accumulator line to the tank line when the control pressure is greater than a combination of a working pressure in the first connection line and a pressure equivalent of a spring.

9. The lifting mechanism suspension according to claim 7, further comprising:

a throttle non-return valve arranged in the control pressure line adjacent to a control pressure chamber of the main valve acting in a main valve opening direction, wherein an opening direction of the non-return valve is directed away from the control pressure chamber, and wherein the main valve has additional activation positions and is constantly adjustable.

10. A lifting mechanism suspension for a lifting mechanism, the lifting mechanism suspension comprising:

a main valve having an activation position in which a hydraulic accumulator or an accumulator line connected to an accumulator is connected to a first connection line that acts in a lifting direction, while a second connection line acting in a lowering direction is connected to a tank line, and a deactivation position in which the first and second connection lines and the tank line are disconnected from one another, while the hydraulic accumulator or the accumulator line is configured to be connected to a pressure medium source via a fifth connection of the main valve, wherein:

the pressure medium source includes a variable displacement pump that supplies at least one lifting mechanism the pressure medium source is connected to the fifth connection of the main valve via a pump line, one of the pump line and the accumulator line is secured via an adjustable pressure-limiting valve, and the pump line is connected to a load pressure signaling line via an electrically actuated switching valve, which is configured to transfer a pump pressure in the pump line to a displacement device of the variable displacement pump.

11. A lifting mechanism comprising:

a double-acting lifting cylinder defining a first cylinder chamber acting in a lifting direction and a second cylinder chamber acting in a lowering direction;

a control valve connected to the first cylinder chamber via a first working line acting in the lifting direction and to the second cylinder chamber via a second working line acting in the lowering direction; and a lifting mechanism suspension comprising:

a main valve having an activation position in which a hydraulic accumulator or an accumulator line connected to an accumulator is connected to a first connection line that acts in the lifting direction, while a second connection line acting in the lowering direction is connected to a tank line, and a deactivation position in which the first and second connection lines and the tank line are disconnected from one another, while the hydraulic accumulator or the accumulator line is configured to be connected to a pressure medium source via a fifth connection of the main valve; and a filler valve which creates a 2-way flow regulator with a throttle, the filler valve arranged between the pressure medium source and the fifth connection, wherein the first connection line is connected to the first working line and the second connection line is connected to the second working line.

12. The lifting mechanism according to claim 11, further comprising:

a control valve block in which the control valve is received, wherein the lifting mechanism suspension further comprises a valve block with which the control valve block is compatible.

* * * * *